US006822398B2

(12) United States Patent
Murr et al.

(10) Patent No.: US 6,822,398 B2
(45) Date of Patent: Nov. 23, 2004

(54) ILLUMINATION UNIT HAVING AT LEAST ONE ESSENTIALLY U-SHAPED GAS DISCHARGE LAMP

(75) Inventors: Jochen Murr, Bornheim (DE); Klaus Wammes, Bechtheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/367,280

(22) Filed: Feb. 19, 2003

(65) Prior Publication Data

US 2004/0051431 A1 Mar. 18, 2004

Related U.S. Application Data

(63) Continuation of application No. PCT/DE01/03130, filed on Aug. 16, 2001.

(30) Foreign Application Priority Data

Aug. 16, 2000 (DE) ..... 100 39 966

(51) Int. Cl.[7] ..... G09G 3/10; H01J 17/20
(52) U.S. Cl. ..... 315/169.4; 313/639
(58) Field of Search ..... 315/169.4, 105, 315/106, 114, 115, 291, DIG. 2, DIG. 4; 313/634, 639, 571

(56) References Cited

U.S. PATENT DOCUMENTS 5,309,062 A * 5/1994 Perkins et al. ..... 315/53
5,907,222 A * 5/1999 Lengyel et al. ..... 315/158
5,909,085 A 6/1999 Nelson
5,971,567 A 10/1999 Van Duijneveldt
6,184,622 B1 * 2/2001 Lovell et al. ..... 315/41
6,294,881 B1 * 9/2001 Miyazaki et al. ..... 315/224
6,359,761 B1 * 3/2002 Sid ..... 361/42
6,366,208 B1 * 4/2002 Hopkins et al. ..... 340/650
6,373,185 B1 * 4/2002 Tyler ..... 313/491

FOREIGN PATENT DOCUMENTS

WO WO 98/12471 A1 3/1998

* cited by examiner

*Primary Examiner*—Don Wong
*Assistant Examiner*—Minh Dieu A
(74) *Attorney, Agent, or Firm*—Sughrue Mion, PLLC

(57) ABSTRACT

A substantially U-shaped gas discharge lamp (1'), containing mercury for the gas discharge, is connected to a high-frequency driver circuit (6'). To ensure that the gas discharge lamp operates with minimum loss and maximum light yield, the respective output terminals (4', 5') of the high-frequency driver circuit are not electrically grounded and the central section (11') of the gas discharge lamp is capacitively coupled to an electric ground. A substantial reduction of lamp current in the central section is ensured, thus lowering thermal production in the central section of the gas discharge lamp. Accordingly, the central section becomes the coldest place in the gas discharge chamber and the place where condensation of the mercury occurs. The mercury vapor pressure can thus be regulated and the light yield optimized.

11 Claims, 3 Drawing Sheets

ILLUMINATION UNIT HAVING AT LEAST ONE ESSENTIALLY U-SHAPED GAS DISCHARGE LAMP

This is a Continuation of International Application PCT/DE01/03130, with an international filing date of Aug. 16, 2001, which was published under PCT Article 21(2) in German, and the disclosure of which is incorporated into this application by reference.

FIELD OF AND BACKGROUND OF THE INVENTION

Gas discharge lamps, in particular fluorescent lamps, are used for illumination purposes in many ways. An exemplary use for gas discharge lamps is the background illumination (backlight) of display units that are not self-illuminating, such as liquid crystal displays (LCD's).

Gas discharge lamps include a lamp body, the shape of which depends on the application, in which a gas discharge chamber is implemented between two electrodes. The chamber is filled with a gaseous atmosphere made of a noble gas or a mixture of noble gases, such as argon and xenon, and at least a slight admixture of mercury. The noble gases are necessary for implementing the gas discharge, but contribute only slightly to generating light. The mercury atoms, in contrast, are excited by collisions with free electrons to emit ultraviolet light, which, in the case of fluorescent lamps, is converted into visible light by a fluorescent layer on the inside of the lamp. As the temperature rises, the mercury vapor pressure, and therefore the number of mercury atoms available in the gas atmosphere to produce light, increases. However, since the mercury atoms in the gas atmosphere also have a light-absorbing effect, an optimum operating temperature of, for example 50° C., results in regard to the light yield of the gas discharge lamp. If the temperature rises above, or drops below, the optimum operating level, the light yield diminishes.

Positioning a thermoelectric cooler at an arbitrary position on the outside of the gas discharge lamp is known, for example, from U.S. Pat. No. 5,909,085. Since, in principle, mercury condenses at the coldest point in the gas discharge chamber, the mercury vapor pressure may be kept constant by activating the thermoelectric cooler at lamp temperatures above 50° C., without requiring cooling of the entire gas discharge lamp.

In order to reach and/or maintain the optimum operating temperature as rapidly as possible upon starting the gas discharge lamp, or when operating at low ambient temperatures, a heating spiral can additionally be wound around the known gas discharge lamp over the entire length of the lamp. Relatively large leakage capacitances between the gas discharge lamp and the heating spiral result from this. Due to these leakage capacitances, operation of the gas discharge lamp at high frequencies, above 10 kHz, leads to corresponding output losses. On the other hand, however, high-frequency activation of gas discharge lamps is desirable, due to the higher associated light yield, the gas column burning more stably without going out in the current zeros, and the phase shift between the lamp current and the lamp voltage approaching zero.

As already mentioned, gas discharge lamps may have a lamp body having a unique shape depending on the application. An illumination unit implemented as a back-lit backlight is known from WO 98/12471, in which essentially U-shaped fluorescent lamps are arranged in a metallized light box, which is open on one side and covered with a diffuser to promote uniform light emission.

OBJECTS OF THE INVENTION

Objects of the present invention are to achieve operation of gas discharge lamps with as little leakage as possible and as large a light yield as possible, in a simple manner.

SUMMARY OF THE INVENTION

According to one formulation of the present invention, the above and other objects are achieved by an illumination unit having at least one essentially U-shaped gas discharge lamp, which contains mercury for gas discharge and whose electrodes are connected to output terminals of a high-frequency driver circuit. The output terminals of the high-frequency driver circuit are each electrically floating and the gas discharge lamp is capacitively coupled to an electrical ground in its central region. Accordingly, as will be described in more detail below, the lamp current is drastically reduced in the central region of the gas discharge lamp, where the parallel lengthwise parts of the gas discharge lamp are connected to one another. Heat generation is, accordingly, drastically reduced at this location and the coldest point in the gas discharge chamber, a point at which the mercury may condense, forms. In this way, effective regulation of the mercury vapor pressure in the gas discharge lamp is achieved in a simple manner, without requiring active cooling means with independent current consumption.

Capacitive coupling of the central region of the gas discharge lamp to electrical ground is equivalent to a short circuit at this region. Thus, the lamp current in the parallel lengthwise parts of the gas discharge lamp is not reduced in any way, but rather is increased. Due to very slight leakage capacitances, which cannot be completely avoided, between the two parallel lengthwise parts of the gas discharge lamp and electrical ground, the lamp current in each of the two lengthwise parts slightly decreases equally in the direction extending from the respective electrode up to the central region of the gas discharge lamp. The leakage field resulting from the lamp current in the two parallel lengthwise parts, therefore, totals zero.

In order to be able to effectively dissipate excess heat in the central region of the gas discharge lamp, the gas discharge lamp may be additionally coupled to a thermal ground, the thermal and electrical grounds can be formed in practice by a single component, for example, a plate. In this case, the thermal coupling may be improved further with the aid of heat conduction paste. However, in any case, the quantity of heat to be dissipated is much lower than in the known gas discharge lamps, because the heat generation in the central region of the lamp is significantly reduced in the gas discharge lamp according to the present invention.

In a preferred embodiment of the illumination unit according to the present invention, the electrical and/or thermal ground comprises a metallic light box. Within the metallic box at least one gas discharge lamp is arranged in a way that the electrodes of the gas discharge lamp project out of one side of the light box and the central region of the gas discharge lamp presses against the opposite side of the light box.

In order to make the output terminals of the high-frequency driver circuit electrically floating, this circuit preferably has an output transformer having windings respectively on the circuit and lamp sides, the output terminals being implemented at the ends of the winding on the lamp side.

BRIEF DESCRIPTION OF THE DRAWINGS

In the following, reference is made to the figures of the drawing to further explain the present invention in detail.

DETAILED DESCRIPTION OF THE PREFERRED EMBODIMENTS

Figure 1:
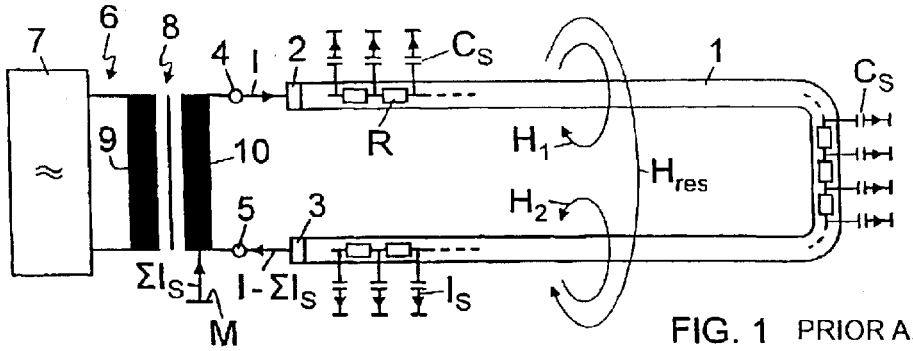
FIG. 1 PRIOR ART
FIG. 1 shows a simplified exemplary circuit of a typical illumination unit having a U-shaped gas discharge lamp and a high-frequency driver circuit.
Figure 2:
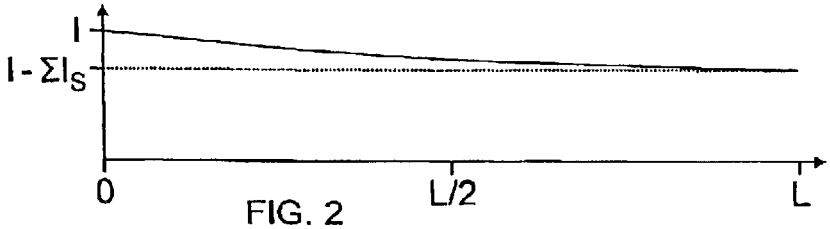
FIG. 2 PRIOR ART
FIG. 2 shows an example of the curve of the lamp current in the known illumination unit shown in FIG. 1.

In order to more fully understand the present invention, a brief description of the conventional gas discharge lamp is first provided with reference to FIGS. 1 and 2.

FIG. 1 shows a U-shaped gas discharge lamp 1, containing a small quantity of mercury in addition to its noble gas filling, whose electrodes 2 and 3 are connected to the output terminals 4 and 5 of a high-frequency driver circuit 6. The high-frequency driver circuit 6 contains driver electronics 7 and an output transformer 8 having a winding 9 on the circuit side and a winding 10 on the lamp side, whose ends are connected to the output terminals 4 and 5. The output terminal 5 is connected to an electrical ground M. Due to the high-frequency drive of the gas discharge lamp 1, leakage capacitances are active between the lamp and the electrical ground M, which lead to leakage losses.

The leakage capacitances are illustrated here in simplified form as single capacitances Cs, but actually form a continuous distributed capacitance over the length of the gas discharge lamp 1. The impedance of the gas discharge path within the gas discharge lamp 1 is also illustrated here in simplified form as single impedances R between the leakage capacitances Cs. Leakage currents Is continuously leak from lamp current I, which flows into the gas discharge lamp 1 from the output terminal 4, which is further from ground, via the leakage capacitances Cs, in the direction of the electrical ground M. As a result, a lamp current I which is reduced by the total of all leakage currents Is exits the gas discharge lamp 1 at the output terminal 5 connected to the electrical ground M. Because of this, the brightness of the gas discharge lamp 1 falls from the electrode 2 in the direction toward the electrode 3 and a leakage field Hres results in the surroundings of the gas discharge lamp 1. More particularly, the leakage filed Hres results because the values of the lamp current at the respective directly opposing points of the two parallel lengthwise parts of the gas discharge lamp 1 have different strengths, and therefore different leakage fields H1 and H2 are generated.

FIG. 2 is an example of a current curve of the lamp illustrated in FIG. 1. The curve of FIG. 2 demonstrates that the current falls continuously over the length L of the gas discharge lamp 1 due to the leakage losses.

Figure 3:
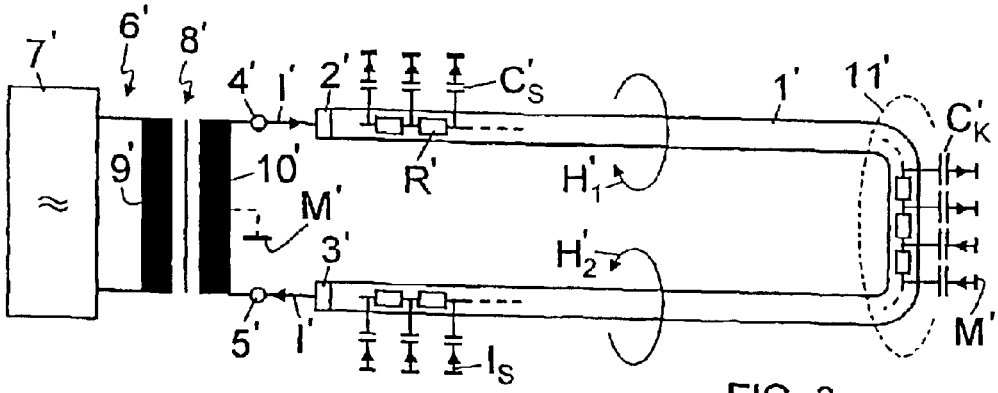
FIG. 3 shows a simplified exemplary circuit of the illumination unit according to the present invention having a U-shaped gas discharge lamp and a high-frequency driver circuit.

The exemplary circuit of the illumination unit according to the present invention shown in FIG. 3 differs from the known illumination unit shown in FIG. 1 in that both output terminals 4' and 5' of the high-frequency driver circuit 6' in FIG. 3 are floating and the gas discharge lamp 1' is capacitively coupled to an electrical ground M' in its central region 11', i.e., where the two parallel lengthwise parts of the gas discharge lamp 1' are connected to one another via a transverse part. As is indicated using dashes, the winding 10' of the transformer 8' on the lamp side may possibly also be connected via a central tap to the electrical ground M', in order to achieve forced symmetrization in regard to the driving of the gas discharge lamp 1'. However, a transformer center-tap connection to gound has no significance for the basic operation of the gas discharge lamp 1'.

Due to the unavoidable leakage capacitances Cs, leakage currents Is flow in the illumination unit according to the present invention as well. However, in contrast to the example shown in FIG. 1, the currents shown in FIG. 3 flow out of one half of the gas discharge lamp 1' and flow back in the other half of the lamp. The lamp current, therefore, has its maximum value I' at both electrodes 2' and 3' of the gas discharge lamp 1', and falls slightly in both halves of the gas discharge lamp 1' outward from the electrodes 2' and/or 3' in the direction toward the middle of the gas discharge lamp 1', due to the leakage currents Is. The leakage fields H1' and H2' produced by the lamp current flowing through directly opposing points of the two lamp halves therefore have equal absolute values and cancel one another out, so that no resulting leakage field arises.

In the central region 11' of the gas discharge lamp 1', lamp current flowing in the gas discharge path is significantly reduced due to the desired large capacitive coupling to the electrical ground M'. According to this embodiment, the capacitive coupling Ck' acts like a short circuit, which taps a large part of the lamp current out of the gas discharge path at the beginning of the central region 11' of the gas discharge lamp 1', guides it past the central region 11', and feeds it back into the gas discharge path at the end of the central region 11'. Due to the significantly reduced lamp current in the central region 11' of the gas discharge lamp 1', the heat generation is also significantly reduced in the region 11', so that the coldest point in the gas discharge lamp is in this region 11' and the mercury contained in the gas atmosphere can condense in this area. In this way, the mercury vapor pressure in the gas discharge chamber is regulated.

Figure 4:
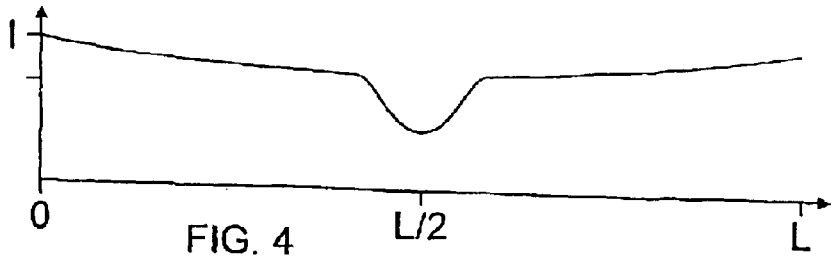
FIG. 4 shows an example of the curve of the lamp current in the illumination unit shown in FIG. 3.

FIG. 4 shows an example of the curve of the lamp current described above over the length L of the gas discharge lamp 1'. As illustrated, the electrical current is at a minimum at the middle (L/2) of the length of a lamp 1'.

Figure 5:
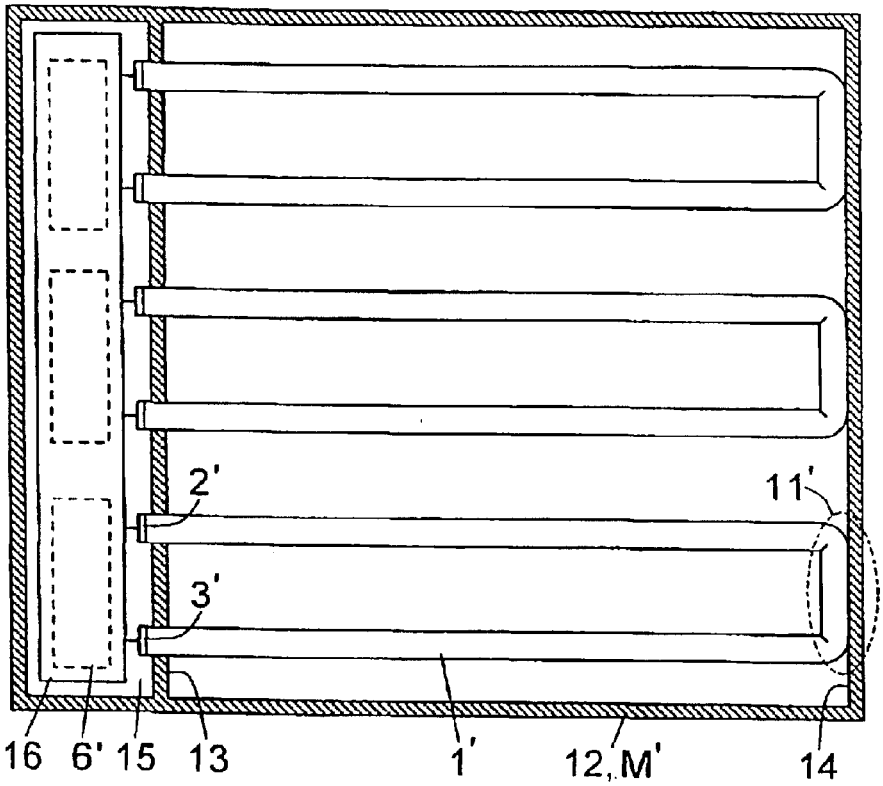
FIG. 5 shows an exemplary embodiment of the illumination unit according to the present invention having gas discharge lamps arranged in a light box.
Figure 6:
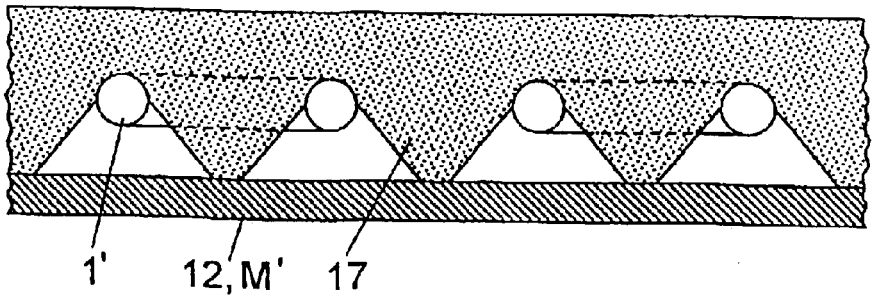
FIG. 6 shows a partial cross-section through the illumination unit shown in FIG. 5.

The exemplary embodiment of the illumination unit according to the present invention shown in FIG. 5 has four of the gas discharge lamps 1' shown in FIG. 3, which are arranged lying next to one another in a light box 12 in such a way that the electrodes 2' and 3' project out of the light box 12 on one side 13 and the central regions 11' of the gas discharge lamps 1' press against the opposite side 14 of the light box 12 in electrically capacitive and thermal contact with opposite side 14. In this case, the light box 12 forms both the electrical ground M' and a thermal ground for dissipating the heat transferred from the gas discharge lamp 1' onto the side 14. A compartment 15 adjoins the side 13 of the light box 12 to receive the high-frequency driver circuits 6', assembled into a unit 16 here, for the individual fluorescent lamps 1'. The light box 12 is metallized on the inside and, as shown in FIG. 6 in a partial cross-section through the illumination unit shown in FIG. 5, covered by a diffuser 17 on the side facing the observer, in order to achieve a uniform light distribution.

The capacitive coupling of the central region 11' of the gas discharge lamp 1' to the electrical ground M' formed by the light box 12 may, for example, be amplified by a metal coating on the relevant point of the gas discharge lamp 1' or through suitable arrangement of a sheet metal part. The central region 11' of the gas discharge lamp 1' may also be positioned in a suitable recess in the side 14 of the light box 12 or, in an alternative arrangement to the example shown in FIG. 5, press against the outside of the light box 12. Finally, the thermal and electrical coupling to ground may be increased using heat conduction paste.

The above description of the preferred embodiments has been given by way of example. From the disclosure given, those skilled in the art will not only understand the present invention and its attendant advantages, but will also find apparent various changes and modifications to the structures and methods disclosed. It is sought, therefore, to cover all such changes and modifications as fall within the spirit and scope of the invention, as defined by the appended claims, and equivalents thereof.

What is claimed is:

1. An illuminating unit comprising:

at least one substantially U-shaped gas discharge lamp comprising mercury operable to promote gas discharge and electrodes connected respectively to output terminals of a high-frequency driver circuit, wherein the output terminals of the high-frequency driver circuit are each electrically floating and wherein a central region of the gas discharge lamp located midway between the electrodes is capacitively coupled to an electrical ground.

2. The illumination unit according to claim 1, wherein the at least one gas discharge lamp is coupled to a thermal ground at the central region.

3. The illumination unit according to claim 1, wherein the electrical ground comprises a metallic light box in which the at least one gas discharge lamp is arranged such that the electrodes of the gas discharge lamp project from one side of the light box and the central region of the lamp presses against an opposite side of the light box.

4. The illumination unit according to claim 2, wherein the thermal ground comprises a metallic light box in which the at least one gas discharge lamp is arranged such that the electrodes of the gas discharge lamp project from one side of the light box and the central region of the lamp presses against an opposite side of the light box.

5. The illumination unit according to claim 1, wherein the high-frequency driver circuit comprises an output transformer comprising respective windings on a circuit side and a lamp side, and the output terminals are provided on ends of the winding on the lamp side.

6. A gas discharge lamp comprising:

a substantially U-shaped sealed container operable to contain gas, wherein said sealed container comprises at least two opposing portions and a transverse portion connecting the opposing portions; and electrodes connected respectively to output terminals of a high-frequency driver circuit, wherein the output terminals of the high-frequency driver circuit are each electrically floating and wherein the transverse portion of the gas discharge lamp located midway between said electrodes is capacitively coupled to an electrical ground.

7. A gas discharge lamp as claimed in claim 6, further comprising:

a plurality of electrodes each respectively connected to one of the opposing portions of said container; and a transformer comprising a drive side and a lamp side, wherein the drive side is electrically connected to a drive circuit and the lamp side is electrically connected to said electrodes.

8. A gas discharge lamp as claimed in claim 7, wherein a center tap of said transformer is coupled to electrical ground.

9. A gas discharge lamp as claimed in claim 7, wherein the drive circuit comprises output terminals that are electrically floating.

10. A gas discharge lamp as claimed in claim 6, wherein each of the opposing portions of said container respectively comprise a leakage field determined by a leakage current associated with the respective portion of the container, and wherein the respective leakage fields are equal in magnitude.

11. A gas discharge lamp as claimed in claim 6, further comprising a metallic housing, wherein the transverse portion of said container is in contact with said metallic housing.

* * * * *